US008360571B2

(12) United States Patent
Kinoshita

(10) Patent No.: US 8,360,571 B2
(45) Date of Patent: Jan. 29, 2013

(54) RECORDING METHOD AND RECORDING APPARATUS

(75) Inventor: Hiroyuki Kinoshita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 12/965,753

(22) Filed: Dec. 10, 2010

(65) Prior Publication Data

US 2011/0298858 A1 Dec. 8, 2011

(30) Foreign Application Priority Data

Jun. 8, 2010 (JP) ..... 2010-131254

(51) Int. Cl.
*B41J 2/01* (2006.01)

(52) U.S. Cl. ..... 347/102; 347/34; 347/16

(58) Field of Classification Search ..... 347/5, 9, 347/16, 34, 102; 346/25
See application file for complete search history.

(56) References Cited

U.S. PATENT DOCUMENTS 5,296,873 A * 3/1994 Russell et al. ..... 346/25
6,367,906 B1 * 4/2002 Hiramatsu et al. ..... 347/34

FOREIGN PATENT DOCUMENTS

JP 2000-255053 A 9/2000

* cited by examiner

*Primary Examiner* — Lam S Nguyen
(74) *Attorney, Agent, or Firm* — Canon U.S.A., Inc. IP Division

(57) ABSTRACT

First humidified gas is supplied from a first supply port to a sheet to be conveyed to increase the moisture content of the sheet. Second humidified gas is supplied to a space where nozzles of the inkjet recording head are exposed, from a second supply port provided at a position closer to the inkjet recording head than the first supply port to increase the atmosphere humidity of the space. The part of the sheet of which the moisture content has been increased is made to enter the space where the atmosphere humidity has been increased, and recording is performed. When a conveyance operation stops, the quantity of flow or humidity of the first humidified gas is reduced. In resupplying a temporarily returned sheet, the amount of moisture to be provided by the first humidified gas is set in accordance with regions of the sheet.

16 Claims, 4 Drawing Sheets

RECORDING METHOD AND RECORDING APPARATUS

BACKGROUND OF THE INVENTION

1. Field of the Invention

The present invention relates to a recording method and recording apparatus capable of reducing drying out of ink of an inkjet recording head.

2. Description of the Related Art

Japanese Patent Laid-Open No. 2000-255053 discloses a technique of, in a printer that includes a plurality of inkjet recording heads arranged in a direction in which a sheet is conveyed, reducing drying out of ink by improving the moisture retention of the recording heads by supplying humidified gas from the upstream to adjacent areas of the nozzles of the recording heads.

SUMMARY OF THE INVENTION

According to an aspect of the present invention, a method for recording on a sheet supplied from a sheet supply unit, with a recording head of an inkjet type in which nozzles are formed, includes supplying first humidified gas to the sheet with a first supply port, supplying second humidified gas to a space where the nozzles are exposed with a second supply port, performing, using the recording head, recording on a part of the sheet which has entered the space where atmosphere humidity is increased, after moisture content of the part is increased in the supplying the first humidified gas, and in resupplying the sheet to the space after the sheet supplied to the recording unit is temporarily returned to the sheet supply unit, setting an amount of moisture to be provided by the first humidified gas supplied with the first supply port in accordance with regions of the sheet.

Further features of the present invention will become apparent from the following description of exemplary embodiments with reference to the attached drawings.

DESCRIPTION OF THE EMBODIMENTS

A sheet made of a material such as paper has an equilibrium water content corresponding to humidity (at which the moisture of the sheet is not changed any more). If the humidity is high, the sheet absorbs moisture from the gas; if the humidity is low, moisture is emitted from the sheet. When a sheet is supplied to adjacent areas of a recording head in a state at which humidity is increased by sent humidified gas, the sheet absorbs moisture. Thus the atmospheric humidity decreases, and this may result in poor humidification of the recording head. In particular, with a configuration in which a plurality of recording heads are arranged along a direction in which humidified gas is introduced, because it takes much time to transport the humidified gas from the upstream to the downstream, if the sheet absorbs moisture during the transporting, the moisture retention of a downstream recording head tends to be insufficient.

Figure 1:
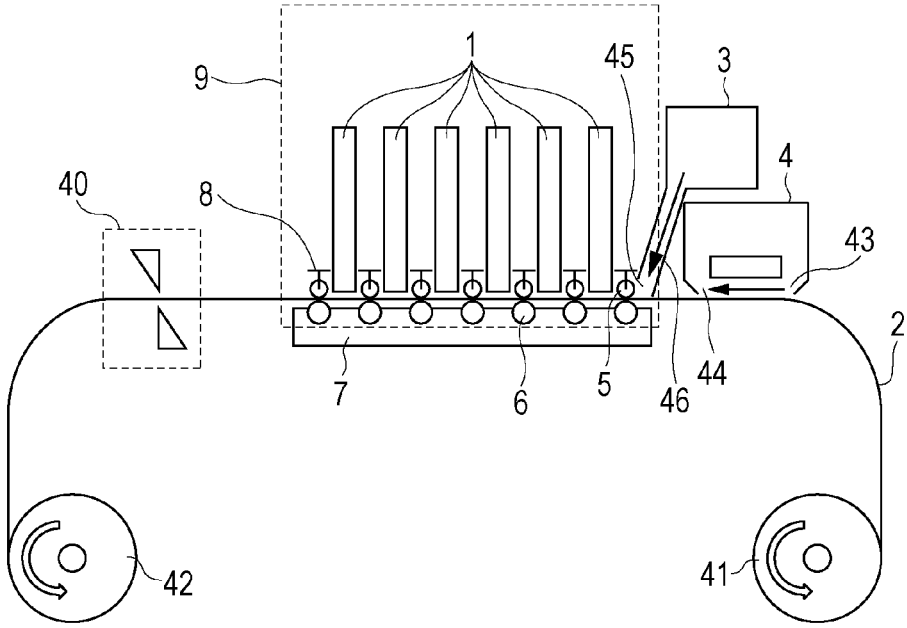
FIG. 1 illustrates a configuration of an inkjet recording apparatus according to an embodiment of the present invention.

FIG. 1 illustrates a configuration of a recording apparatus according to an embodiment of the present invention. In the drawing, the arrows indicate a flow of humidified gas. In the present embodiment, humidified gas is used. However, another gas other than air may also be humidified. The sheet is conveyed downstream along the sheet conveyance path while printing. At an arbitrary position in the sheet conveyance path where the sheet is conveyed from feeding means to discharging means, a side toward the feeding means is referred to as "the upstream side", and the opposite side toward the discharging means is referred to as "the downstream side".

The recording apparatus according to the present embodiment is of so-called roll to roll type. A sheet supply unit 41 supplies a continuous sheet 2 from a roll. A sheet winding unit 42 winds a sheet on which information is recorded by a recording unit 9. In FIG. 1, the sheet supply unit 41 holds a single roll. However, the sheet supply unit 41 may hold a plurality of rolls and selectively supply a sheet therefrom.

The recording unit 9 includes a housing indicated by the dotted line in FIG. 1 and is formed as a unitary structure in which a conveyance mechanism and a recording unit are disposed in the housing. The conveyance mechanism includes a platen 7 assisting in supporting the sheet 2 and a plurality of pairs of rollers, each pair including a driving roller 6 and a driven roller 5. The driving roller 6 is rotatably embedded in part in the platen 7 and is rotated by a driving source to convey the sheet 2. The driven roller 5 is supported by a support member 8 (holder) and is arranged at a position that faces the driving roller 6 such that the sheet 2 is disposed therebetween. A recording head 1 forming the recording unit is disposed between the pairs of the driving rollers 6 and the driven rollers 5. The recording head 1 is a fixed full-line inkjet recording head in which nozzles for use in ejecting ink therethrough are arranged along the maximum recording width in the width direction of the sheet 2. The inkjet system in the present embodiment is a system that uses a heating element. However, it is also applicable to a system that uses a piezoelectric element, an electrostatic element, or a micro-electromechanical systems (MEMS) element. The recording heads 1 corresponding to the number of colors (in FIG. 1, six) are aligned along the direction of conveyance of a sheet and integrally retained by the support member 8. Ink is supplied to the recording heads 1 from an ink supply unit (not illustrated), such as an ink tank. Each of the recording heads 1 may be formed as a unitary structure integral with an ink tank storing a corresponding color. The recording unit 9 is of line print system and forms an image by providing ink of each color from the recording head 1 corresponding to the color to the moving sheet 2. In the present embodiment, a rolled sheet being a continuous sheet is used as the sheet 2. However, other types of sheet, for example, a continuous sheet folded for each unit length and a cut sheet, may also be used.

A first humidifying unit 4 (first humidifying unit) is disposed upstream of the recording unit 9 in a sheet conveyance path. The first humidifying unit 4 humidifies the sheet 2 before the sheet 2 is conveyed to the recording unit 9. The first humidifying unit 4 supplies humidified gas (first humidified gas) to the sheet 2 before the sheet 2 enters the recording unit 9 to increase the moisture content by causing the sheet to absorb moisture. The first humidifying unit 4 includes a humidifying device, a blowing device, a supply port 43 (first supply port), and a gas intake 44. Gas in the first humidifying unit 4 humidified by the humidifying device (first humidified gas) is issued by the blowing device through the supply port 43 and supplied to the sheet 2 prior to entry to the recording unit 9. The gas intake 44 can be disposed at any position as long as it allows air to be taken into the first humidifying unit 4. The supply port 43 and the gas intake 44 are spaced away from each other along the sheet conveyance path. The supply port 43 is oriented so as to allow humidified gas to be supplied therethrough toward the sheet 2 from a direction close to being parallel to the sheet 2. Because gas supplied through the supply port 43 can be taken through the gas intake 44, humidified gas can be circulated and the amount of water for use in the humidifying device can be reduced.

Aside from the first humidifying unit 4, a second humidifying unit 3 (second humidifying unit) configured to humidify narrow space to which the nozzles of the recording heads 1 of the recording unit 9 are exposed is disposed. The atmospheric humidity of the narrow space to which the nozzles of the plurality of recording heads 1 are exposed can be increased by humidified gas (second humidified gas) fed by the second humidifying unit 3 through a sheet introducing port of the recording unit 9. This can improve the moisture retention of the nozzles of the plurality of recording heads and reduce drying out thereof. The second humidifying unit 3 is provided with a humidifying device, a blowing device, and a gas intake common to the first humidifying unit 4. The second humidifying unit 3 is connected to a supply duct 46. The supply duct 46 has an end being a supply port 45 (second supply port) allowing humidified gas to be issued therethrough. The supply port 45 is disposed in the vicinity of the sheet introducing port of the recording unit 9. Humidified gas (second humidified gas) is supplied through the supply port 45 to the narrow space within the recording unit 9. The supply port 43 and the gas intake 44 of the first humidifying unit 4 are disposed upstream of the supply port 45 of the second humidifying unit 3 when being viewed from the recording unit 9. Because humidified gas generated by the second humidifying unit 3 is introduced into the supply port 45 through the supply duct 46, a humidified-gas generating section of the second humidifying unit 3 may not be disposed between the recording unit 9 and the first humidifying unit 4.

The humidified gas supplied from the second humidifying unit 3 flows from the upstream to the downstream in the conveyance path for the sheet 2 and its adjacent narrow space in the recording unit 9. Specifically, at the position of each of the recording heads 1, the humidified gas passes through a gap between a tip of the recording head (a surface at which the nozzles are formed) and the sheet (hereinafter referred to as "recording gap"). Between the neighboring recording heads 1, the humidified gas passes through a gap between the support member 8 and the sheet 2. That is, the humidified gas passes through two kinds of gaps before reaching the downstream recording head 1. For the inkjet system, the recording gap is typically narrow at approximately 1 mm. When the humidified gas is passing through the recording gap, the velocity of flow of the humidified gas is increased, and this may affect the accuracy of causing droplets (main droplets and satellite droplets) ejected from the recording head 1 to reach a target during recording. Accordingly, the velocity of flow of the humidified gas supplied from the second humidifying unit 3 at the recording gap can be set at 1 m/sec. or less.

A cutter unit 40 including a cutter for cutting a continuous sheet is disposed downstream of the recording unit 9. Although not illustrated, similar cutter units are disposed at a plurality of positions other than the position of the cutter unit 40. Each of these cutter units may be an automatic cutter that automatically cuts a sheet or a manual cutter by which an operator manually cuts a sheet. As described below, if a trouble, such as a paper jam in sheet conveyance, an ejection defect of the recording head, or exhaustion of ink, occurs during a recording operation, the continuous sheet is cut by the cutter unit 40, and the sheet upstream of the sheet cut position is returned to the sheet supply unit 41, whereas the sheet downstream of the cut position is wound to the sheet winding unit 42.

Figure 2:
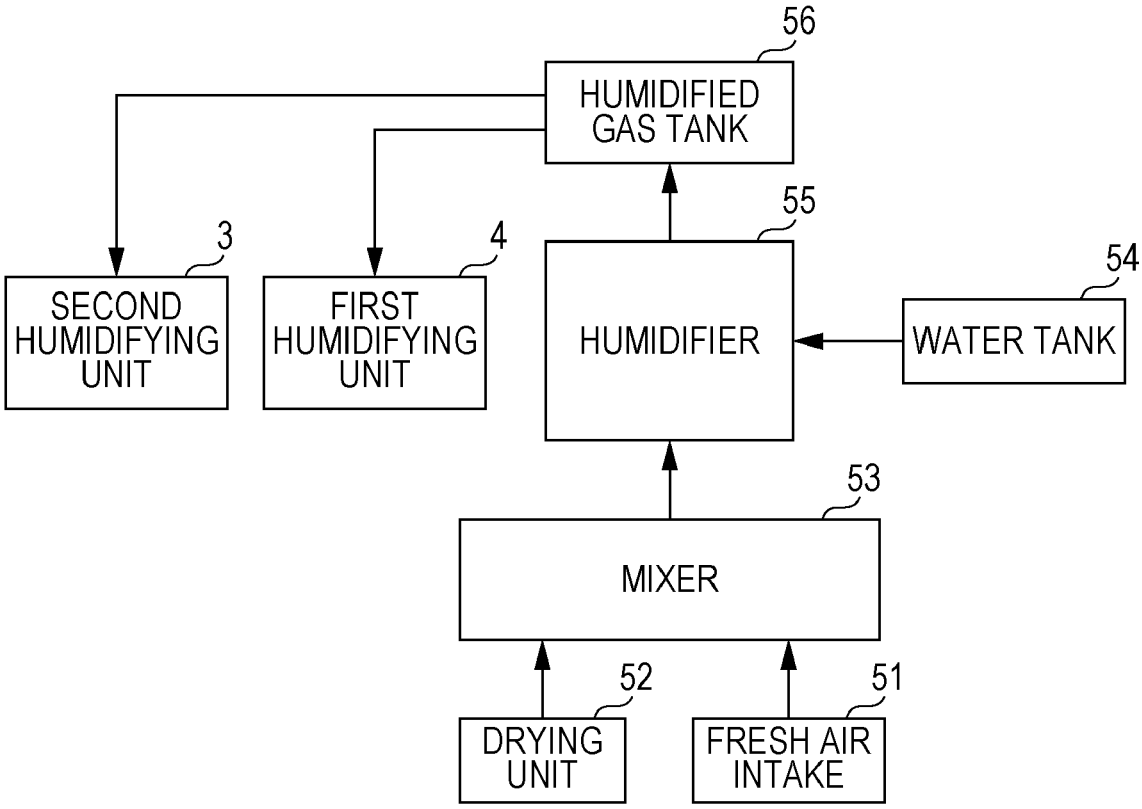
FIG. 2 is a system diagram of an example humidifying device.

FIG. 2 is a system diagram of the humidifying device for supplying humidified gas to the first humidifying unit 4 and the second humidifying unit 3. Fresh air introduced from a fresh air intake 51 and exhaust discharged from a drying unit 52 are mixed in a mixer 53 to form mixed gas having a temperature suited as humidified gas. The drying unit 52 (not illustrated in FIG. 1) is a unitary structure for forcefully drying a sheet moistened with ink used in recording by the recording unit 9 before the sheet is wounded to the sheet winding unit 42. The drying unit 52 discharges gas with high humidity and high temperature. This energy is partially used in generation of humidified gas, and thus the entire energy efficiency of the apparatus is high. The mixed gas from the mixer 53 and water supplied from a water tank 54 are mixed by a humidifier 55 to form humidified gas having temperature and humidity necessary for supplying moisture to the sheet 2. The humidified gas formed by the humidifier 55 is temporarily stored in a humidified gas tank 56. An amount of humidified gas necessary for recording is fed to each of the first humidifying unit 4 and the second humidifying unit 3, thus causing each humidifying unit to operate so as to enable the sheet 2 to have a necessary humidification state. Each of the mixer 53 and the humidifier 55 includes a heater arranged therein and can finely adjust mixed gas or humidified gas to an optimal temperature.

The first humidified gas supplied from the first humidifying unit 4 and the second humidified gas supplied from the second humidifying unit 3 are described below. The atmosphere around the recording head 1 is required to be an atmosphere in which ink is not easily vaporized from the recording head 1. For example, if the temperature is approximately 30° C. to 40° C., the relative humidity is on the order of 60% to 70%. Thus it is useful that the relative humidity of the second humidifying unit 3 be on the order of 60% to 70%; however, it may be other values as long as vaporization of ink from the recording head 1 can be reduced. It is useful that the first humidifying unit 4 cause the sheet 2 to absorb moisture such that the sheet 2 has an equilibrium water content. Because the amount of water that can be absorbed by the sheet 2 varies with the type of the sheet 2, typically, humidified gas having a temperature substantially equal to or more than the absolute temperature of the humidified gas supplied from the second humidifying unit 3 can be supplied from the first humidifying unit 4 to the sheet 2.

Figure 3:
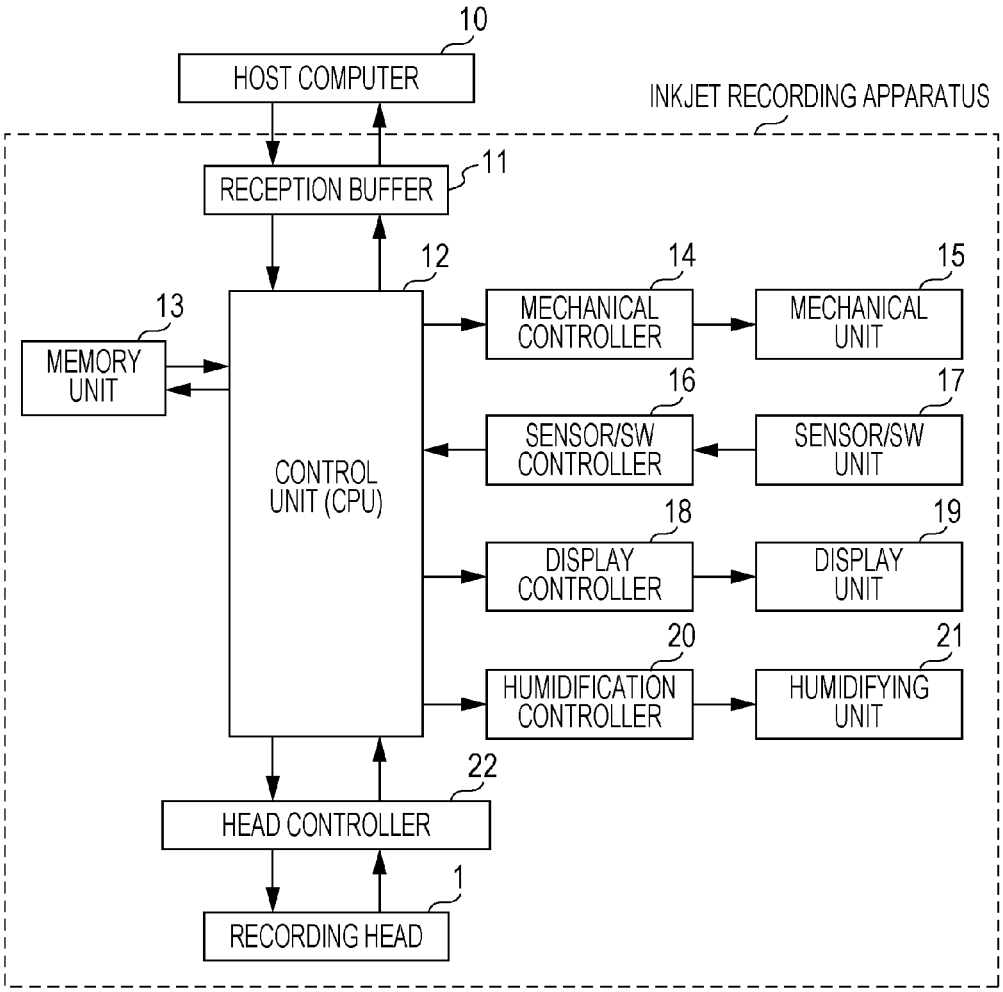
FIG. 3 is a block diagram of a control system.

FIG. 3 is a block diagram of a control system of the inkjet recording apparatus according to the present embodiment. Data of characters and images to be recorded is input to a reception buffer 11 of the inkjet recording apparatus from a host computer 10. Data for use in checking whether data has been correctly transferred or data informing an operating state of the inkjet recording apparatus is output from the inkjet recording apparatus to the host computer 10. The data in the reception buffer 11 is transferred to a memory unit 13 and temporarily stored in a random-access memory (RAM) under control of a central processing unit (CPU) 12 being a control unit. A mechanical controller 14 drives a mechanical unit 15, such as a line head carriage, a cap, and a wiper, in response to an instruction from the CPU 12. A sensor/switch (SW) controller 16 sends, to the CPU 12, a signal from a sensor/SW unit 17 including various sensors, such as a temperature sensor and a humidity sensor, and switches. A display controller 18 controls a display unit 19, such as a liquid crystal indicator, in response to an instruction from the CPU 12. A humidification controller 20 controls a humidifying unit 21 (first humidifying unit 4 and second humidifying unit 3) in response to an instruction from the CPU 12. At this time, the CPU 12 determines the water content to be supplied to the sheet 2 on the basis of various kinds of information, for example, ambient temperature, type and thickness of the sheet 2, temperature of the line head, or the quantity of input of image data to be recorded, and sets a humidification condition in the humidifying unit 21. A head controller 22 drives and controls the recording head 1 in response to an instruction from the CPU 12, detects temperature information indicating the state of the recording head 1, and notifies it to the CPU 12.

For the aforementioned configuration, the first humidifying unit 4 is disposed upstream of the recording unit 9 in the sheet conveyance path and supplies the first humidified gas to the sheet prior to entry to the recording unit 9. Thus, the moisture content of the sheet can be increased before it enters the recording unit 9. The second humidifying unit 3 supplies the second humidified gas through the sheet introducing unit such that the humidified gas flows from the upstream to the downstream along the conveyance path in the recording unit 9. In the recording unit 9, before the sheet is introduced, the second humidified gas is fed in advance. Thus the atmospheric humidity of the narrow space to which the nozzles of the recording head 1 are exposed is increased, and the moisture retention of the recording head is improved. From the viewpoint of operation, in a first step, the first humidified gas is supplied through the first supply port to a conveyed sheet to increase the moisture content of the sheet. At the same time, in a second step, the second humidified gas is supplied to the narrow space to which the nozzles are exposed through the second supply port disposed closer to the recording head than the first supply port is to increase the atmospheric humidity of the narrow space and thus improve the moisture retention of the nozzles. In a third step, a site of the sheet with the moisture content increased in the first step is caused to enter the narrow space with the atmospheric humidity increased in the second step, and information is recorded using the inkjet recording head.

Accordingly, when a sheet is passing through space during recording, because the moisture content of the sheet is previously increased by the first humidified gas, absorption of moisture in the second humidified gas by the sheet is reduced. Thus high humidity of the narrow space from the upstream recording head to the downstream recording head can be maintained, and the moisture retention of the nozzles can be reliably improved. As a result, the occurrence of ink ejection defects, such as being unable to eject ink or incorrect direction of ink ejection, can be reduced.

Next, a recovery operation when a trouble occurs during image recording is described. During a recording operation, a plurality of images are sequentially recorded on a continuous sheet supplied by the recording unit 9 from the sheet supply unit 41, and the continuous sheet is then wound to the sheet winding unit 42. Unfortunately, recording may be required to stop because of a sheet conveyance defect caused by a paper jam or because of an ejection defect of the recording head 1 or exhaustion of ink. In this case, where such a trouble occurs, the sheet conveyance is halted, and an operator conducts a maintenance task as an occasional task.

If the first humidifying unit 4 and the second humidifying unit 3 continue humidifying the sheet during the maintenance task, only the humidified region of the sheet has an increased moisture content. In performing the maintenance task, the continuous sheet is cut, and the sheet upstream of the cut position is temporarily returned to the sheet supply unit. Depending on the positional relationship with the humidifying unit, the returned sheet includes a plurality of regions having different humidified conditions. That is, there are three kinds of regions: a "region that remained in the vicinity of the humidifying unit from the halt of the conveyance to the start of the returning and thus has been highly humidified," a "region that passed by the humidifying unit in the returning and thus has been subjected twice to humidification," and a "region that has never passed by the humidifying unit." The "region that has never passed by the humidifying unit" is a region of the sheet upstream of the first humidifying unit 4. In the restarted recording operation, if such regions having different humidified conditions are subjected to uniform humidification, an excessively humidified partial region may appear. This may cause supplied ink to be irregularly distributed and may cause bleeding in that region, and the image quality may be degraded.

To address this issue, for the present embodiment, if a sheet conveyance operation is halted, the quantity of flow or humidity of humidified gas supplied through the supply port 43 is reduced to restrict the water content provided to the sheet after the halt of the conveyance. The amount of moisture to be provided by humidified gas supplied through the supply port 43 is variably set in accordance with regions of the sheet in resupplying the sheet after the sheet supplied to the recording unit 9 is temporarily returned to the sheet supply unit 41. A specific procedure is described below.

Figure 4:
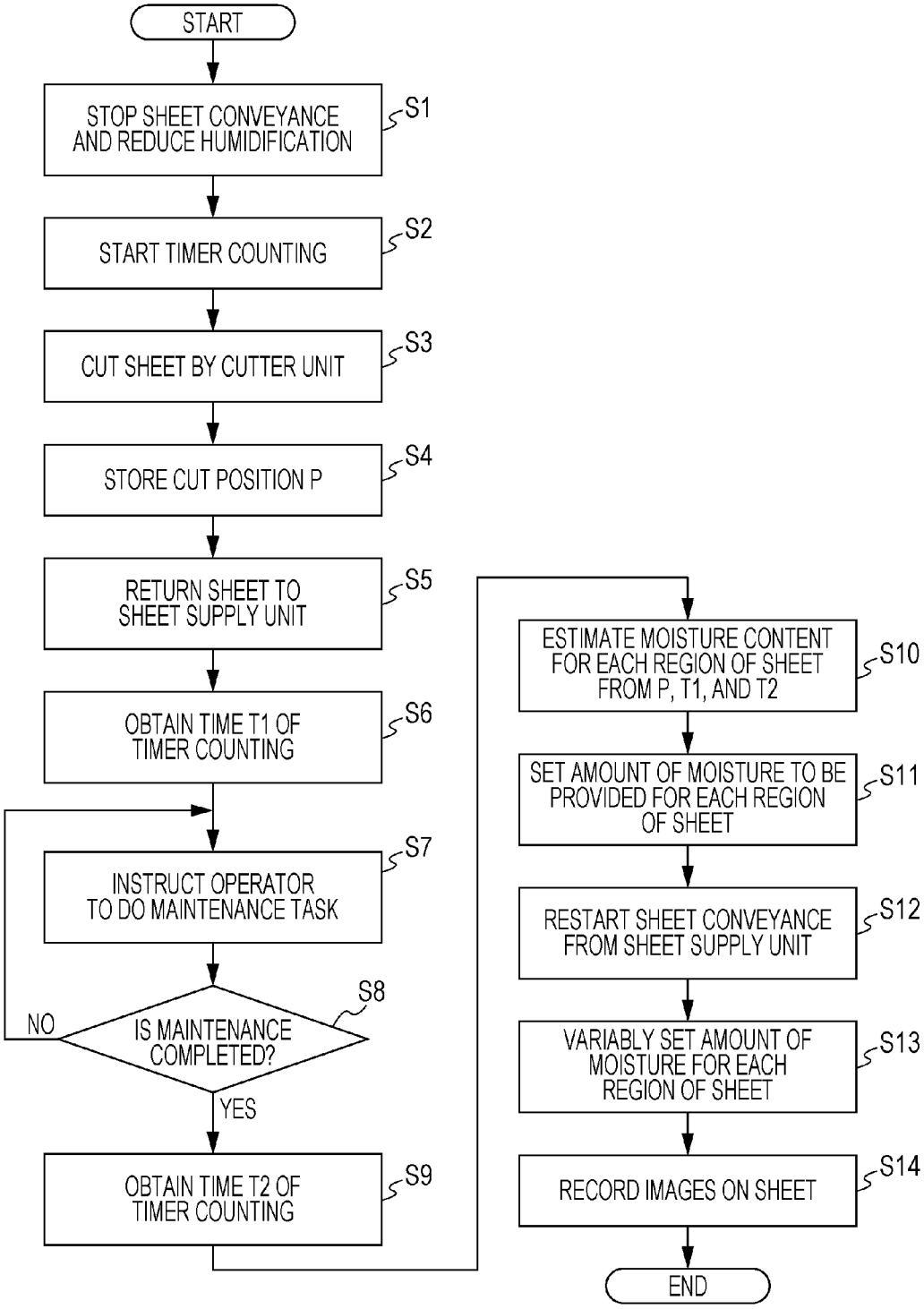
FIG. 4 is a flowchart of a sequence of a recovery operation when a trouble occurs.

FIG. 4 is a flowchart of a sequence of a recovery operation when a trouble occurs. In step S1, when a trouble that needs halting of sheet conveyance occurs, the sheet conveyance of the entire apparatus is halted, and humidification performance of the first humidifying unit 4 is reduced. The reduction in the humidification performance can be achieved by reducing generation performance of the humidifier 55 for the first humidifying unit 4, changing a mixture ratio at the mixer 53, halting the blowing device for the first humidifying unit 4, reducing the area of the opening of the supply port 43, or other ways. The reduction in the humidification performance of the first humidifying unit 4 can reduce excessive humidification of a part of the sheet at rest caused by the humidifying region of the first humidifying unit 4. A supply of humidified gas from the second humidifying unit 3 is maintained. This aims at maintaining improvement of the moisture retention of the nozzles of the recording head.

In step S2, to measure a halt time from the halt of the sheet conveyance, the control unit starts timer counting.

In step S3, the continuous sheet is cut by a cutter unit. In the case of a paper jam, the sheet is cut by a cutter unit adjacent to the position of the occurrence of the paper jam. The sheet may be cut by the same cutter unit (e.g., the cutter unit 40) on every occasion.

In step S4, the sheet cut position P by the cutter unit used in the cutting is obtained. If the same cutter unit is used at every occasion, because the cut position P is a constant value, step S4 may be omitted.

In step S5, the sheet left upstream of the cut position is fed back, returned to the sheet supply unit 41, and wound back to the roll. At the same time, the sheet left downstream of the cut position is wound to the sheet winding unit 42.

In step S6, after the returning is completed, the control unit obtains a time T1 of the timer counting at that point in time. Even after the time T1 is obtained, the timer counting continues.

In step S7, an operator is instructed to do a maintenance task for recovering from the trouble. Examples of the maintenance task can be removing a sheet piece occurring in a paper jam, an inspection or replacement of a recording head, and refilling with ink. The maintenance task procedure is displayed on the display unit 19. In step S8, the apparatus waits until the operator completes the maintenance task.

In step S9, upon the completion of the maintenance task, the control unit obtains a time T2 of the timer counting at that point in time.

In step S10, the moisture content is estimated for each region of the returned sheet from the obtained parameters P, T1, and T2. As described above, there are three kinds of regions, that is, a "region that remained in the vicinity of the humidifying unit from the halt of the conveyance to the start of the returning and thus has been highly humidified," a "region that passed by the humidifying unit in the returning and thus has been subjected twice to humidification," and a "region that has never passed by the humidifying unit." The positions of these regions can be determined from a specific positional relationship between a region humidified by the first humidifying unit 4, a region humidified in the recording unit 9 by the second humidifying unit 3, and a cut position by the cutter unit. The control unit specifies a plurality of (three) regions in accordance with distances with reference to the end of the cut sheet and estimates the moisture content for each region.

The region to which the humidified gas is provided from the first humidifying unit 4 is continuously made more humid during the period T1 and its moisture content increases with an increase in T1. In contrast, the moisture contained in the sheet wound back to the sheet supply unit 41 is vaporized or distributed during the period T2, and the water content of each region reduces with an increase in T2. The relationship between the period T1 for humidification and the moisture content of the sheet is stored in advance in the memory of the control unit as a function or the form of a data table. The moisture content of each region can be calculated from the obtained T1 using such a function or data table, the amount of decrease in the moisture can be calculated from the obtained T2, and the moisture content of the sheet for each region at the time of the obtainment of T2 can be estimated using these addition and subtraction.

In step S11, the amount of moisture to be provided to the returned sheet is set for each region on the basis of the estimation in step S10. That is, the amount of moisture to be provided again is set to be small (a decrease from a standard is set to be large) for a region that has a relatively high moisture content, whereas the amount of moisture to be provided again is set to be large (a decrease from a standard is set to be small) for a region that has a relatively low moisture content.

In the estimation in step S10 or the setting in step S11, the accuracy can be enhanced using another parameter. Examples of such another parameter can include temperature and humidity of the inside of the first humidifying unit 4 (or the first humidified gas supplied through the supply port 43), temperature and humidity of the inside of the second humidifying unit 3 (or the second humidified gas supplied through the supply port 45), temperature and humidity of the inside of the sheet supply unit 41, temperature and humidity of the inside of the recording unit 9, and temperature and humidity of a set environment of the recording apparatus. The temperatures and humidities are obtained by a temperature sensor or a humidity sensor. The type of a used sheet may also be employed as another parameter. In this case, because the equilibrium water content or hygroscopicity of a sheet varies with the type of the sheet, a data table in which the sheet types and the equilibrium water content or hygroscopicity are associated is stored in the memory in advance, and the data is referred to in the estimation or setting. The use of at least one of the above-described parameters in the estimation or setting can enhance the accuracy.

In step S12, a sheet supply from the sheet supply unit 41 is started to restart sheet conveyance. In step S13, the amount of moisture to be provided to the supplied sheet is variably set for each sheet region. Specifically, the control unit variably sets at least one of the quantity of flow of humidified gas supplied through the 43 and humidity of the humidified gas in real time in accordance with regions of the sheet passing by a zone to which the humidified gas is provided (a zone from the supply port 43 to the gas intake 44). To change the quantity of flow, the quantity of gas blown from the blowing device or the area of the opening of the supply port 45 is changed. To change the humidity, the humidification performance of the humidifier 55 for the first humidifying unit 4 or the mixture ratio at the mixer 53 is changed. To variably set the amount of moisture to be provided for each sheet region, the sheet conveyance velocity may be changed in real time. The actual amount of moisture provided reduces with an increase in the speed in which the sheet passes by the region to which the humidified gas is supplied, whereas the actual amount of moisture provided increases with a reduction in the speed in which the sheet passes. A plurality of factors may be changed at the same time using any combination of the quantity of flow of humidified gas supplied through the supply port 43, the humidity thereof, and the sheet conveyance velocity. In this way, after the completion of the passage of the regions of the returned sheet, the first humidifying unit 4 retains normal constant humidification performance.

In step S14, a plurality of images are sequentially recorded on the sheet. After the completion of all scheduled image recording, the flow ends.

In step S1, humidification performance of the first humidifying unit 4 is reduced simultaneously with the halt of sheet conveyance. Therefore, excessively humidifying a part of the sheet by the first humidifying unit 4 can be reduced. However, if the halt continues for a long time, excessive humidification may occur. In this case, an excessively humidified region may be set as a blank region or a head maintenance region for use in preliminary ejection on the sheet without being used in image formation.

With the present embodiment, absorption of moisture by a sheet is reduced by previous humidification of the sheet, the moisture retention of a recording head can be properly maintained, and ejection defects can be reduced. Additionally, proper humidification of a sheet in accordance with regions in resupplying the sheet to the recording unit after temporarily returning the sheet to the sheet supply unit enables recording with an image quality substantially free of irregularities.

In resupplying a sheet to the recording unit 9 after temporarily returning the sheet to the sheet supply unit 41, the moisture content of a leading end of the sheet is higher than a normal one. Accordingly, the present embodiment is also advantageous in that, because recording can be restarted without waiting until the humidity of the inside of the first humidifying unit 4 reducing during maintenance becomes a normal state, a waiting time required to restart recording is short.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-131254 filed Jun. 8, 2010, which is hereby incorporated by reference herein in its entirety.

What is claimed is:

1. A method for recording on a sheet supplied from a sheet supply unit, with a recording head of an inkjet type in which nozzles are formed, the method comprising:

supplying first humidified gas to the sheet with a first supply port;

supplying second humidified gas to a space where the nozzles are exposed with a second supply port;

performing, using the recording head, recording on a part of the sheet which has entered the space where atmosphere humidity is increased, after moisture content of the part is increased in the supplying the first humidified gas, and in resupplying the sheet to the space after the sheet supplied to the recording unit is temporarily returned to the sheet supply unit, setting an amount of moisture to be provided by the first humidified gas supplied with the first supply port in accordance with regions of the sheet.

2. The recording method according to claim 1, wherein a plurality of the recording heads are arranged along a direction in which the sheet is conveyed, and wherein at least a part of the second humidified gas supplied with the second supply port flows along the direction through a narrow space including a gap between the nozzles of the plurality of the recording heads and the sheet.

3. The method according to claim 1, wherein the sheet supply unit is configured to supply a continuous sheet, the continuous sheet on which information is recorded is cut by a cutter unit, and the cut continuous sheet is returned to the sheet supply unit.

4. The method according to claim 3, wherein a plurality of regions are specified in accordance with positions with respect to an end of the cut sheet, the moisture content of the sheet for each region is estimated, and the amount of moisture provided to each region is set based on the estimated moisture content.

5. The method according to claim 4, wherein the provided amount of moisture is set in accordance with a time from halting of sheet conveyance to returning of the cut sheet to the sheet supply unit and a time from the halting of sheet conveyance to restarting of a recording operation.

6. The method according to claim 4, wherein the provided amount of moisture is set using at least one of (1) temperature or humidity of the first humidified gas, (2) temperature or humidity of the second humidified gas, (3) temperature or humidity of an inside of the sheet supply unit, (4) temperature or humidity of an inside of the space, (5) temperature or humidity of an environment, and (6) a type of the sheet used.

7. The method according to claim 1, wherein when a sheet conveyance operation stops, a quantity of flow or humidity of the first humidified gas to be supplied with the first supply port is reduced.

8. The method according to claim 7, wherein even after the sheet conveyance operation stops, supplying the second humidified gas through the second supply port is maintained.

9. An apparatus comprising:

a sheet supply unit configured to supply a sheet;

a recording unit including an inkjet recording head having nozzles;

a first supply port for supplying first humidified gas to a sheet to be conveyed;

a second supply port for supplying second humidified gas to a space where the nozzles are exposed, the second supply port is provided at a position between to the recording head and the first supply port in a direction in which the sheet is conveyed; and a control unit configured to, in resupplying the sheet to the recording unit after the sheet supplied to the recording unit is temporarily returned to the sheet supply unit, set an amount of moisture to be provided by the first humidified gas supplied with the first supply port in accordance with regions of the sheet.

10. The apparatus according to claim 9, wherein in the recording unit, a plurality of the recording heads are arranged along the direction, and wherein at least a part of the second humidified gas supplied with the second supply port flows through a narrow space including a gap between the nozzles of the plurality of the recording heads and the sheet.

11. The apparatus according to claim 9, wherein the sheet supply unit is configured to supply a continuous sheet, the continuous sheet on which information is recorded is cut by a cutter unit, and the cut continuous sheet is returned to the sheet supply unit.

12. The apparatus according to claim 11, wherein a plurality of regions are specified in accordance with positions with respect to an end of the cut sheet, the moisture content of the sheet for each region is estimated, and the amount of moisture provided to each region is set based on the estimated moisture content.

13. The apparatus according to claim 12, wherein the provided amount of moisture is set in accordance with a time from halting of sheet conveyance to returning of the cut sheet to the sheet supply unit and a time from the halting of sheet conveyance to restarting of a recording operation.

14. The apparatus according to claim 12, wherein the provided amount of moisture is set using at least one of (1) temperature or humidity of the first humidified gas, (2) temperature or humidity of the second humidified gas, (3) temperature or humidity of an inside of the sheet supply unit, (4) temperature or humidity of an inside of the space, (5) temperature or humidity of an environment, and (6) a type of the sheet used.

15. The apparatus according to claim 9, wherein when a sheet conveyance operation stops, a quantity of flow or humidity of the first humidified gas to be supplied with the first supply port is reduced.

16. The apparatus according to claim 15, wherein even after the sheet conveyance operation stops, supplying the second humidified gas through the second supply port is maintained.

* * * * *